US007926750B2

(12) United States Patent
Hauserman

(10) Patent No.: US 7,926,750 B2
(45) Date of Patent: Apr. 19, 2011

(54) COMPACTOR FEEDER

(75) Inventor: William B. Hauserman, Shoreview, MN (US)

(73) Assignee: GreatPoint Energy, Inc., Cambridge, MA (US)

( * ) Notice: Subject to any disclaimer, the term of this patent is extended or adjusted under 35 U.S.C. 154(b) by 190 days.

(21) Appl. No.: 12/395,381

(22) Filed: Feb. 27, 2009

(65) Prior Publication Data

US 2009/0218424 A1 Sep. 3, 2009

Related U.S. Application Data

(60) Provisional application No. 61/032,709, filed on Feb. 29, 2008.

(51) Int. Cl.
*B02C 13/286* (2006.01)

(52) U.S. Cl. ..... 241/27; 241/186.5

(58) Field of Classification Search ..... 241/186.5, 241/246, 248, 27

See application file for complete search history.

(56) References Cited

U.S. PATENT DOCUMENTS

| | | | | |
|---|---|---|---|---|
| 2,813,126 | A | 11/1957 | Tierney | |
| 2,886,405 | A | 5/1959 | Benson et al. | |
| 3,034,848 | A * | 5/1962 | King | 8/524 |
| 3,114,930 | A | 12/1963 | Oldham et al. | |
| 3,164,330 | A * | 1/1965 | Neidl | 241/165.5 |
| 3,435,590 | A | 4/1969 | Smith | |
| 3,531,917 | A | 10/1970 | Grunewald et al. | |
| 3,594,985 | A | 7/1971 | Ameen et al. | |
| 3,615,300 | A | 10/1971 | Holm et al. | |
| 3,689,240 | A | 9/1972 | Aldridge et al. | |
| 3,740,193 | A | 6/1973 | Aldridge et al. | |
| 3,759,036 | A | 9/1973 | White | |
| 3,779,725 | A | 12/1973 | Hegarty et al. | |
| 3,828,474 | A | 8/1974 | Quartulli | |
| 3,833,327 | A * | 9/1974 | Pitzer et al. | 425/203 |
| 3,847,567 | A | 11/1974 | Kalina et al. | |
| 3,904,386 | A | 9/1975 | Graboski et al. | |
| 3,915,670 | A | 10/1975 | Lacey et al. | |
| 3,920,229 | A | 11/1975 | Piggott | |
| 3,929,431 | A | 12/1975 | Koh et al. | |
| 3,958,957 | A | 5/1976 | Koh et al. | |
| 3,969,089 | A | 7/1976 | Moss et al. | |
| 3,975,168 | A | 8/1976 | Gorbaty | |
| 3,985,519 | A | 10/1976 | Kalina et al. | |

(Continued)

FOREIGN PATENT DOCUMENTS

| | | |
|---|---|---|
| CA | 966660 | 4/1975 |

(Continued)

OTHER PUBLICATIONS

Asami, K., et al., "Highly Active Iron Catalysts from Ferric Chloride or the Steam Gasification of Brown Coal," ind. Eng. Chem. Res., vol. 32, No. 8, 1993, pp. 1631-1636.

(Continued)

*Primary Examiner* — Mark Rosenbaum

(74) *Attorney, Agent, or Firm* — McDonnell Boehnen Hulbert & Berghoff LLP

(57) ABSTRACT

A compactor feeder and methods for feeding relatively low-density biomass materials into a grinding device (such as a hammer mill) is described. The compactor feeder increases the density of the relatively low-density biomass materials in order to fill the grinding device with the biomass materials at a rate that is sufficient to substantially equal the design capacity of the grinding device.

16 Claims, 1 Drawing Sheet

U.S. PATENT DOCUMENTS 3,998,607 A 12/1976 Wesselhoft et al.
3,999,607 A 12/1976 Pennington et al.
4,005,996 A 2/1977 Hausberger et al.
4,021,370 A 5/1977 Harris et al.
4,046,523 A 9/1977 Kalina et al.
4,053,554 A 10/1977 Reed et al.
4,057,512 A 11/1977 Vadovic et al.
4,069,304 A 1/1978 Starkovich et al.
4,077,778 A 3/1978 Nahas et al.
4,091,073 A 5/1978 Winkler
4,092,125 A 5/1978 Stambaugh et al.
4,094,650 A 6/1978 Koh et al.
4,100,256 A 7/1978 Bozzelli et al.
4,101,449 A 7/1978 Noda et al.
4,104,201 A 8/1978 Banks et al.
4,118,204 A 10/1978 Eakman et al.
4,152,119 A 5/1979 Schulz
4,157,246 A 6/1979 Eakman et al.
4,159,195 A 6/1979 Clavenna
4,193,771 A 3/1980 Sharp et al.
4,193,772 A 3/1980 Sharp
4,200,439 A 4/1980 Lang
4,204,843 A 5/1980 Neavel
4,211,538 A 7/1980 Eakman et al.
4,211,669 A 7/1980 Eakman et al.
4,219,338 A 8/1980 Wolfs et al.
4,235,044 A 11/1980 Cheung
4,243,639 A 1/1981 Haas et al.
4,260,421 A 4/1981 Brown et al.
4,265,868 A 5/1981 Kamody
4,284,416 A 8/1981 Nahas
4,292,048 A 9/1981 Wesselhoft et al.
4,315,758 A 2/1982 Patel et al.
4,318,712 A 3/1982 Lang et al.
4,330,305 A 5/1982 Kuessner et al.
4,331,451 A 5/1982 Isogaya et al.
4,334,893 A 6/1982 Lang
4,336,034 A 6/1982 Lang et al.
4,336,233 A 6/1982 Appl et al.
4,347,063 A 8/1982 Sherwood et al.
4,348,486 A 9/1982 Calvin et al.
4,348,487 A 9/1982 Calvin et al.
4,353,713 A 10/1982 Cheng
4,365,975 A 12/1982 Williams et al.
4,375,362 A 3/1983 Moss
4,397,656 A 8/1983 Ketkar
4,400,182 A 8/1983 Davies et al.
4,407,206 A 10/1983 Bartok et al.
4,428,535 A * 1/1984 Venetucci ..... 241/35
4,432,773 A 2/1984 Euker, Jr. et al.
4,433,065 A 2/1984 Van Der Burgt et al.
4,436,531 A 3/1984 Estabrook et al.
4,439,210 A 3/1984 Lancet
4,444,568 A 4/1984 Beisswenger et al.
4,459,138 A 7/1984 Soung
4,462,814 A 7/1984 Holmes et al.
4,466,828 A 8/1984 Tamai et al.
4,468,231 A 8/1984 Bartok et al.
4,500,323 A 2/1985 Siegfried et al.
4,508,544 A 4/1985 Moss
4,515,604 A 5/1985 Eisenlohr et al.
4,515,764 A 5/1985 Diaz
4,540,681 A 9/1985 Kustes et al.
4,541,841 A 9/1985 Reinhardt
4,551,155 A 11/1985 Wood et al.
4,558,027 A 12/1985 McKee et al.
4,597,775 A 7/1986 Billimoria et al.
4,597,776 A 7/1986 Ullman et al.
4,604,105 A 8/1986 Aquino et al.
4,609,456 A 9/1986 Deschamps et al.
4,617,027 A 10/1986 Lang
4,619,864 A 10/1986 Hendrix et al.
4,661,237 A 4/1987 Kimura et al.
4,668,428 A 5/1987 Najjar
4,668,429 A 5/1987 Najjar
4,675,035 A 6/1987 Apffel
4,678,480 A 7/1987 Heinrich et al.
4,682,986 A 7/1987 Lee et al.
4,690,814 A 9/1987 Velenyi et al.
4,704,136 A 11/1987 Weston et al.
4,720,289 A 1/1988 Vaugh et al.
4,747,938 A 5/1988 Khan
4,781,731 A 11/1988 Schlinger
4,803,061 A 2/1989 Najjar et al.
4,822,935 A 4/1989 Scott
4,848,983 A 7/1989 Tomita et al.
4,854,944 A 8/1989 Strong
4,861,360 A 8/1989 Apffel
4,876,080 A 10/1989 Paulson
4,960,450 A 10/1990 Schwarz et al.
4,995,193 A 2/1991 Soga et al.
5,017,282 A 5/1991 Delbianco et al.
5,055,181 A 10/1991 Maa et al.
5,057,294 A 10/1991 Sheth et al.
5,059,406 A 10/1991 Sheth et al.
5,093,094 A 3/1992 Van Kleeck et al.
5,094,737 A 3/1992 Bearden, Jr. et al.
5,132,007 A 7/1992 Meyer et al.
5,223,173 A 6/1993 Jeffrey
5,250,083 A 10/1993 Wolfenbarger et al.
5,277,884 A 1/1994 Shinnar et al.
5,435,940 A 7/1995 Doering et al.
5,536,893 A 7/1996 Gudmundsson
5,616,154 A 4/1997 Elliott et al.
5,630,854 A 5/1997 Sealock, Jr. et al.
5,641,327 A 6/1997 Leas
5,720,785 A 2/1998 Baker
5,733,515 A 3/1998 Doughty et al.
5,776,212 A 7/1998 Leas
5,855,631 A 1/1999 Leas
5,865,898 A 2/1999 Holtzapple et al.
6,013,158 A 1/2000 Wootten
6,015,104 A 1/2000 Rich, Jr.
6,028,234 A 2/2000 Heinemann et al.
6,090,356 A 7/2000 Jahnke et al.
6,180,843 B1 1/2001 Heinemann et al.
6,187,465 B1 2/2001 Galloway
6,389,820 B1 5/2002 Rogers et al.
6,506,349 B1 1/2003 Khanmamedov
6,506,361 B1 1/2003 Machado et al.
6,602,326 B2 8/2003 Lee et al.
6,641,625 B1 11/2003 Clawson et al.
6,653,516 B1 11/2003 Yoshikawa et al.
6,692,711 B1 2/2004 Alexion et al.
6,790,430 B1 9/2004 Lackner et al.
6,797,253 B2 9/2004 Lyon
6,808,543 B2 10/2004 Paisley
6,855,852 B1 2/2005 Jackson et al.
6,894,183 B2 5/2005 Choudhary et al.
6,955,695 B2 10/2005 Nahas
7,074,373 B1 7/2006 Warren et al.
7,132,183 B2 11/2006 Galloway
7,205,448 B2 4/2007 Gajda et al.
7,220,502 B2 5/2007 Galloway
7,309,383 B2 12/2007 Beech, Jr. et al.
2003/0167691 A1 9/2003 Nahas
2004/0020123 A1 2/2004 Kimura et al.
2004/0180971 A1 9/2004 Inoue et al.
2005/0107648 A1 5/2005 Kimura et al.
2005/0137442 A1 6/2005 Gajda et al.
2006/0265953 A1 11/2006 Hobbs
2007/0000177 A1 1/2007 Hippo et al.
2007/0051043 A1 3/2007 Schingnitz
2007/0083072 A1 4/2007 Nahas
2007/0180990 A1 8/2007 Downs et al.
2007/0186472 A1 8/2007 Rabovitser et al.
2007/0277437 A1 12/2007 Sheth
2009/0048476 A1 2/2009 Rappas et al.
2009/0090055 A1 4/2009 Ohtsuka
2009/0090056 A1 4/2009 Ohtsuka
2009/0165361 A1 7/2009 Rappas et al.
2009/0165376 A1 7/2009 Lau et al.
2009/0165379 A1 7/2009 Rappas
2009/0165380 A1 7/2009 Lau et al.
2009/0165381 A1 7/2009 Robinson
2009/0165382 A1 7/2009 Rappas et al.
2009/0165383 A1 7/2009 Rappas et al.

| | | | |
|---|---|---|---|
| 2009/0165384 | A1 | 7/2009 | Lau et al. |
| 2009/0166588 | A1 | 7/2009 | Spitz et al. |
| 2009/0169448 | A1 | 7/2009 | Rappas et al. |
| 2009/0169449 | A1 | 7/2009 | Rappas et al. |
| 2009/0170968 | A1 | 7/2009 | Nahas et al. |
| 2009/0217575 | A1 | 9/2009 | Raman et al. |
| 2009/0217582 | A1 | 9/2009 | May et al. |
| 2009/0217584 | A1 | 9/2009 | Raman et al. |
| 2009/0217585 | A1 | 9/2009 | Raman et al. |
| 2009/0217586 | A1 | 9/2009 | Rappas et al. |
| 2009/0217587 | A1 | 9/2009 | Raman et al. |
| 2009/0217588 | A1 | 9/2009 | Hippo et al. |
| 2009/0217589 | A1 | 9/2009 | Robinson |
| 2009/0217590 | A1 | 9/2009 | Rappas et al. |
| 2009/0218424 | A1 | 9/2009 | Hauserman |
| 2009/0220406 | A1 | 9/2009 | Rahman |
| 2009/0229182 | A1 | 9/2009 | Raman et al. |
| 2009/0246120 | A1 | 10/2009 | Raman et al. |
| 2009/0259080 | A1 | 10/2009 | Raman et al. |
| 2009/0260287 | A1 | 10/2009 | Lau |
| 2009/0324458 | A1 | 12/2009 | Robinson et al. |
| 2009/0324459 | A1 | 12/2009 | Robinson et al. |
| 2009/0324460 | A1 | 12/2009 | Robinson et al. |
| 2009/0324461 | A1 | 12/2009 | Robinson et al. |
| 2009/0324462 | A1 | 12/2009 | Robinson et al. |
| 2010/0071262 | A1 | 3/2010 | Robinson et al. |
| 2010/0076235 | A1 | 3/2010 | Reiling et al. |
| 2010/0120926 | A1 | 5/2010 | Robinson et al. |
| 2010/0121125 | A1 | 5/2010 | Hippo et al. |
| 2010/0168494 | A1 | 7/2010 | Rappas et al. |
| 2010/0168495 | A1 | 7/2010 | Rappas et al. |
| 2010/0179232 | A1 | 7/2010 | Robinson et al. |

FOREIGN PATENT DOCUMENTS

| | | |
|---|---|---|
| CA | 1003217 | 1/1977 |
| CA | 1106178 | 8/1981 |
| CA | 1187702 | 6/1985 |
| CN | 1477090 | 2/2004 |
| DE | 2210891 | 9/1972 |
| DE | 2852710 | 6/1980 |
| DE | 3422202 | 12/1985 |
| DE | 100610607 | 6/2002 |
| EA | 819 | 4/2000 |
| EP | 0 067 580 | 12/1982 |
| EP | 102828 | 3/1984 |
| EP | 0 138 463 | 4/1985 |
| EP | 0 225 146 | 6/1987 |
| EP | 0 259 927 | 3/1988 |
| EP | 0 723 930 | 7/1996 |
| EP | 1 001 002 | 5/2000 |
| EP | 1 741 673 | 6/2006 |
| FR | 797 089 | 4/1936 |
| GB | 593910 | 10/1947 |
| GB | 640907 | 8/1950 |
| GB | 676615 | 7/1952 |
| GB | 701 131 | 12/1953 |
| GB | 760627 | 11/1956 |
| GB | 798741 | 7/1958 |
| GB | 996327 | 6/1965 |
| GB | 1033764 | 6/1966 |
| GB | 1448562 | 9/1976 |
| GB | 1453081 | 10/1976 |
| GB | 1467219 | 3/1977 |
| GB | 1467995 | 3/1977 |
| GB | 1 599 932 | 7/1977 |
| GB | 2078251 | 1/1982 |
| GB | 2154600 | 9/1985 |
| JP | 54020003 | 2/1979 |
| JP | 56157493 | 12/1981 |
| JP | 62241991 | 10/1987 |
| JP | 62 257985 | 11/1987 |
| JP | 2000290659 | 10/2000 |
| JP | 2000290670 | 10/2000 |
| JP | 2002105467 | 4/2002 |
| JP | 2004292200 | 10/2004 |
| JP | 2004298818 | 10/2004 |
| WO | WO 00/43468 | 7/2000 |
| WO | WO 02/40768 | 5/2002 |
| WO | WO 02/079355 | 10/2002 |
| WO | WO 03/033624 | 4/2003 |
| WO | WO 2004/072210 | 8/2004 |
| WO | WO 2006/031011 | 3/2006 |
| WO | WO 2007/005284 | 1/2007 |
| WO | WO 2007/047210 | 4/2007 |
| WO | WO 2007/076363 | 7/2007 |
| WO | WO 2007/128370 | 11/2007 |
| WO | WO 2007/143376 | 12/2007 |
| WO | WO 2008/073889 | 6/2008 |
| WO | WO 2009/018053 | 2/2009 |
| WO | WO 2009/048723 | 4/2009 |
| WO | WO 2009/048724 | 4/2009 |
| WO | WO 2009/086361 | 7/2009 |
| WO | WO 2009/086362 | 7/2009 |
| WO | WO 2009/086363 | 7/2009 |
| WO | WO 2009/086366 | 7/2009 |
| WO | WO 2009/086367 | 7/2009 |
| WO | WO 2009/086370 | 7/2009 |
| WO | WO 2009/086372 | 7/2009 |
| WO | WO 2009/086374 | 7/2009 |
| WO | WO 2009/086377 | 7/2009 |
| WO | WO 2009/086383 | 7/2009 |
| WO | WO 2009/086407 | 7/2009 |
| WO | WO 2009/086408 | 7/2009 |
| WO | WO 2009/111330 | 9/2009 |
| WO | WO 2009/111331 | 9/2009 |
| WO | WO 2009/111332 | 9/2009 |
| WO | WO 2009/111335 | 9/2009 |
| WO | WO 2009/111342 | 9/2009 |
| WO | WO 2009/111345 | 9/2009 |
| WO | WO 2009/124017 | 10/2009 |
| WO | WO 2009/124019 | 10/2009 |
| WO | WO 2009/158576 | 12/2009 |
| WO | WO 2009/158579 | 12/2009 |
| WO | WO 2009/158580 | 12/2009 |
| WO | WO 2009/158582 | 12/2009 |
| WO | WO 2009/158583 | 12/2009 |
| WO | WO 2010/033846 | 3/2010 |
| WO | WO 2010/033848 | 3/2010 |
| WO | WO 2010/033850 | 3/2010 |
| WO | WO 2010/033852 | 3/2010 |
| WO | WO 2010/048493 | 4/2010 |
| WO | WO 2010/078297 | 7/2010 |
| WO | WO 2010/078298 | 7/2010 |

OTHER PUBLICATIONS

Berger, R., et al., "High Temperature $CO_2$-Absorption: A Process Offering New Prospects in Fuel Chemistry," The Fifth International Symposium on Coal Combustion, Nov. 2003, Nanjing, China, pp. 547-549.

Brown et al., "Biomass-Derived Hydrogen From A Thermally Ballasted Gasifier," Aug. 2005.

Brown et al., "Biomass-Derived Hydrogen From A Thermally Ballasted Gasifier," DOE Hydrogen Program Contractors' Review Metting, Center for Sustainable Environmental Technologies, Iowa State University, May 21, 2003.

Coal Conversion Processes (Gasification), Encyclopedia of Chemical Technology, $4^{th}$ Edition, vol. 6, pp. 541-566.

Cohen, S.J., Project Manager, "Large Pilot Plant Alternatives for Scaleup of the Catalytic Coal Gasification Process," FE-2480-20, U.S. Dept. of Energy, Contract No., EX-76-C-01-2480, 1979.

Euker, Jr., C.A., Reitz, R.A., Program Managers, "Exxon Catalytic Coal-Gasification-Process Development Program," Exxon Research & Engineering Company, FE-2777-31, U.S. Dept. of Energy, Contract No. ET-78-C-01-2777, 1981.

Kalina, T., Nahas, N.C., Project Managers, "Exxon Catalaytic Coal Gasification Process Predevelopment Program," Exxon Research & Engineering Company, FE-2369-24, U.S. Dept. of Energy, Contract No., E(49-18)-2369, 1978.

Nahas, N.C., "Exxon Catalytic Coal Gasification Process —Fundamentals to Flowsheets," Fuel, vol. 62, No. 2, 1983, pp. 239-241.

Ohtsuka, Y. et al., "Highly Active Catalysts from Inexpensive Raw Materials for Coal Gasification," Catalysis Today, vol. 39, 1997, pp. 111-125.

Ohtsuka, Yasuo et al, "Steam Gasification of Low-Rank Coals with a Chlorine-Free Iron Catalyst from Ferric Chloride," Ind. Eng. Chem.

Res., vol. 30, No. 8, 1991, pp. 1921-1926.
Ohtsuka, Yasuo et al., "Calcium Catalysed Steam Gasification of Yalourn Brown Coal," Fuel, vol. 65, 1986, pp. 1653-1657.
Ohtsuka, Yasuo, et al, "Iron-Catalyzed Gasification of Brown Coal at Low Temperatures," Energy & Fuels, vol. 1, No. 1, 1987, pp. 32-36.
Ohtsuka, Yasuo, et al., "Ion-Exchanged Calcium From Calcium Carbonate and Low-Rank Coals: High Catalytic Activity in Steam Gasification," Energy & Fuels 1996, 10, pp. 431-435.
Ohtsuka, Yasuo et al., "Steam Gasification of Coals with Calcium Hydroxide," Energy & Fuels, vol. 9, No. 6, 1995, pp. 1038-1042.
Pereira, P., et al., "Catalytic Steam Gasification of Coals," Energy & Fuels, vol. 6, No. 4, 1992, pp. 407-410.
Ruan Xiang-Quan, et al., "Effects of Catalysis on Gasification of Tatong Coal Char," Fuel, vol. 66, Apr. 1987, pp. 568-571.
Tandon, D., "Low Temperature and Elevated Pressure Steam Gasification of Illinois Coal," College of Engineering in the Graduate School, Southern Illinois university at Carbondale, Jun. 1996.
"Integrate Gasification Combined Cycle (IGCC)," WorleyParsons Resources & Energy, http://www.worleyparsons.com/v5/p.aspx?id=164.
U.S. Appl. No. 12/778,538, filed May 12, 2010, Robinson, et al.
U.S. Appl. No. 12/778,548, filed May 12, 2010, Robinson, et al.
U.S. Appl. No. 12/778,552, filed May 12, 2010, Robinson, et al.
Adsorption, http://en.wikipedia.org/wiki/Adsorption, pp. 1-8.
Amine gas treating, http://en.wikipedia.org/wiki/Acid_gas_removal, pp. 1-4.
Coal, http://en.wikipedia.org/wiki/Coal_gasification, pp. 1-8.
Coal Data: A Reference, Energy Information Administration, Office of Coal, Nuclear, Electric, and Alternate Fuels U.S. Department of Energy, DOE/EIA-0064(93), Feb. 1995.
Deepak Tandon, Dissertation Approval, "Low Temperature and Elevated Pressure Steam Gasification of Illinois Coal", Jun. 13, 1996.
Demibras, "Demineralization of Agricultural Residues by Water Leaching", *Energy Sources*, vol. 25, pp. 679-687, (2003).
Fluidized Bed Gasifiers, http://www.energyproducts.com/fluidized_bed_gasifiers.htm, pp. 1-5.
Gas separation, http://en.wikipedia.org/wiki/Gas_separation, pp. 1-2.
Gasification, http://en.wikipedia.org/wiki/Gasification, pp. 1-6.
Gallagher Jr., et al., "Catalytic Coal Gasification for SNG Manufacture", *Energy Research*, vol. 4, pp. 137-147, (1980).
Heinemann, et al., "Fundamental and Exploratory Studies of Catalytic Steam Gasification of Carbonaceous Materials", Final Report Fiscal Years 1985-1994.
Jensen, et al. Removal of K and C1 by leaching of straw char, *Biomass and Bioenergy*, vol. 20, pp. 447-457, (2001).
Mengjie, et al., "A potential renewable energy resource development and utilization of biomass energy", http://www.fao.org.docrep/T4470E/t4470e0.n.htm, pp. 1-8.
Meyers, et al. Fly Ash as A Construction Material for Highways, A Manual. Federal Highway Administration, Report No. FHWA-IP-76-16, Washington, DC, 1976.
Moulton, Lyle K. "Bottom Ash and Boiler Slag", *Proceedings of the Third International Ash Utilization Symposium*, U.S. Bureau of Mines, Information Circular No. 8640, Washington, DC, 1973.
Natural gas processing, http://en.wikipedia.org/wiki/Natural_gas_processing, pp. 1-4.
Natural Gas Processing: The Crucial Link Between Natural Gas Production and Its Transportation to Market. Energy Information Administration, Office of Oil and Gas; pp. 1-11, (2006).
Prins, et al., "Exergetic optimisation of a production process of Fischer-Tropsch fuels from biomass", *Fuel Processing Technology*, vol. 86, pp. 375-389, (2004).
Reboiler, http://en.wikipedia.org/wiki/Reboiler, pp. 1-4.
What is XPS?, http://www.nuance.northwestern.edu/Keckll/xps1.asp, pp. 1-2.
2.3 Types of gasifiers, http://www.fao.org/docrep/t0512e/T0512e0a.htm, pp. 1-6.
2.4 Gasification fuels, http://www.fao.org/docrep/t0512e/T0512e0b.htm#TopofPage, pp. 1-8.
2.5 Design of downdraught gasifiers, http://www.fao.org/docrep/t0512e/T0512e0c.htm#TopOfPage, pp. 1-8.
2.6 Gas cleaning and cooling, http://www.fao.org/docrep/t0512e0d.htm#TopOFPage, pp. 1-3.

* cited by examiner

COMPACTOR FEEDER

CROSS-REFERENCE TO RELATED APPLICATIONS

This application claims priority under 35 U.S.C. §119 from U.S. Provisional Application Ser. No. 61/032,709 (filed Feb. 29, 2008), the disclosure of which is incorporated by reference herein for all purposes as if fully set forth.

FIELD OF THE INVENTION

The invention generally relates to preparation of biomass and its use as a carbonaceous feedstock for catalytic gasification. More particularly, the invention provides a compactor feeder for compacting low-density biomass materials to increased density for feeding to a grinding device, such as a hammer mill.

BACKGROUND OF THE INVENTION

In view of numerous factors such as higher energy prices and environmental concerns, the production of value-added gaseous products from lower-fuel-value carbonaceous feedstocks, such as biomass, coal and petroleum coke, is receiving renewed attention. The catalytic gasification of such materials to produce methane and other value-added gases is disclosed, for example, in U.S. Pat. No. 3,828,474, U.S. Pat. No. 3,998,607, U.S. Pat. No. 4,057,512, U.S. Pat. No. 4,092,125, U.S. Pat. No. 4,094,650, U.S. Pat. No. 4,204,843, U.S. Pat. No. 4,468,231, U.S. Pat. No. 4,500,323, U.S. Pat. No. 4,541,841, U.S. Pat. No. 4,551,155, U.S. Pat. No. 4,558,027, U.S. Pat. No. 4,606,105, U.S. Pat. No. 4,617,027, U.S. Pat. No. 4,609,456, U.S. Pat. No. 5,017,282, U.S. Pat. No. 5,055,181, U.S. Pat. No. 6,187,465, U.S. Pat. No. 6,790,430, U.S. Pat. No. 6,894,183, U.S. Pat. No. 6,955,695, US2003/0167961A1, US2006/0265953A1, US2007/000177A1, US2007/083072A1, US2007/0277437A1 and GB1599932.

Treatment of biomass alone can have high theoretical carbon conversion, but has its own challenges regarding maintaining bed composition, fluidization of the bed in the gasification reactor, control of possible liquid phases and agglomeration of the bed in the gasification reactor and char withdrawal. Biomass also has inherently high moisture content, requiring additional handling and drying measures to provide an appropriate feedstock for gasification. One such handling measure is pulverizing or grinding the biomass prior to gasification.

A typical grinding device, such as a hammer mill, has a design operating capacity, defined in pounds per hour, that the device is capable of processing. A hammer mill is designed to be filled with materials at bulk density and fixed volumetric flow rate (cubic feet per minute) that will deliver a mass flow rate (pounds per minute). Ideally, the raw material would be fed to the mill at a rate that meets the hammer mill's design capacity; it is more economical to fill the hammer mill at a mass flow rate that meets the mill's design capacity than to fill the mill at a mass flow rate that is less than the design capacity.

In typical operation, a feeder, such as a single or double screw feeder, draws feed from a bin and discharges the feed into a feed chute connected to the hammer mill. It is possible to meet a hammer mill's design capacity in this manner if materials of high enough density (e.g., 30 to 50 pounds per cubic foot) are supplied to the hammer mill. However, feeders drawing low-density materials (e.g., 10 to 20 pounds per cubic foot) with gravity discharge into the hammer mill's feed chute cannot deliver a sufficient mass flow rate to meet a hammer mill's design capacity.

Therefore, typically, when feeding low-density materials to a grinding device such as a hammer mill, it is not possible to utilize the full design capacity of the grinding device. Running the mill while not providing feed at a mass flow rate that meets the design capacity of the mill wastes valuable power resources. Accordingly, it would be beneficial to densify low-density materials so that low-density materials could be fed into a hammer mill at a mass flow rate that substantially meets the mill's design capacity.

Methods and systems for compacting or densifying materials exist in the prior art. For instance, U.S. Pat. No. 3,920,229 discloses and apparatus for feeding polymeric material in flake form to an extruder, and U.S. Pat. No. 3,114,930 discloses an apparatus for densifying and granulating powdered materials. This apparatus is designed to feed fine, powdered materials to a roll compactor. In this design, a horizontal screw feeds directly into the side of a larger diameter tapered screw. While this prior art shares some of the general components related to the present invention, they do not achieve the goals of the invention, nor yield its advantages.

SUMMARY OF THE INVENTION

In a first aspect, the invention provides a compactor feeder for feeding relatively low-density biomass materials into a processing/grinder or grinder-like apparatus, such as a hammer mill, comprising: (a) a hopper (or the like) within which biomass feed is contained; (b) a feeder connected to the hopper having a first inlet and a charging end, wherein the biomass feed is conveyed from the hopper to the charging end; and (c) a compactor having a tapered conical-shaped interior sidewall with an interior top and bottom. The compactor top has an opening into which the feeder charging end communicates for receiving the charge of the feeder.

The compactor has a screw compactor member that has at least one flight that generally conforms to the interior sidewall. This provides a screw compactor member that has a first wide radial diameter at the top decreasing to a reduced diameter relative to the first diameter at the bottom. At the bottom is a discharge opening in communication with, most preferably, a hammer mill.

A controller controls the rate of the feeder at the charging end into said compactor. Biomass feed is forced from the charging end of the feeder into the compactor at a rate so as to substantially fill the compactor at the top. The compactor member takes the biomass feed and compacts it to an increased density relative to a density at said top before discharge to the hammer mill. The amount of compaction is most preferably keyed to the maximum mass flow rate that the hammer mill can handle.

In another aspect, the invention provides a method for feeding relatively low-density biomass materials into a hammer mill. The method includes providing biomass feed to a compactor feeder, such as the compactor feeder described above. The method further includes controlling the rate of the feeder at the charging end into the compactor at a rate so as to substantially fill the compactor at the top. Still further, the method includes controlling the rate of the compactor at the discharge opening into the hammer mill so as to substantially fill the hammer mill such that the rate of the compactor substantially equals a design capacity of the hammer mill.

These and other objectives, aspects and advantages of the invention will be further understood and appreciated after consideration of the following detailed description taken in conjunction with the drawings, in which:

DETAILED DESCRIPTION

Figures 1, 2:
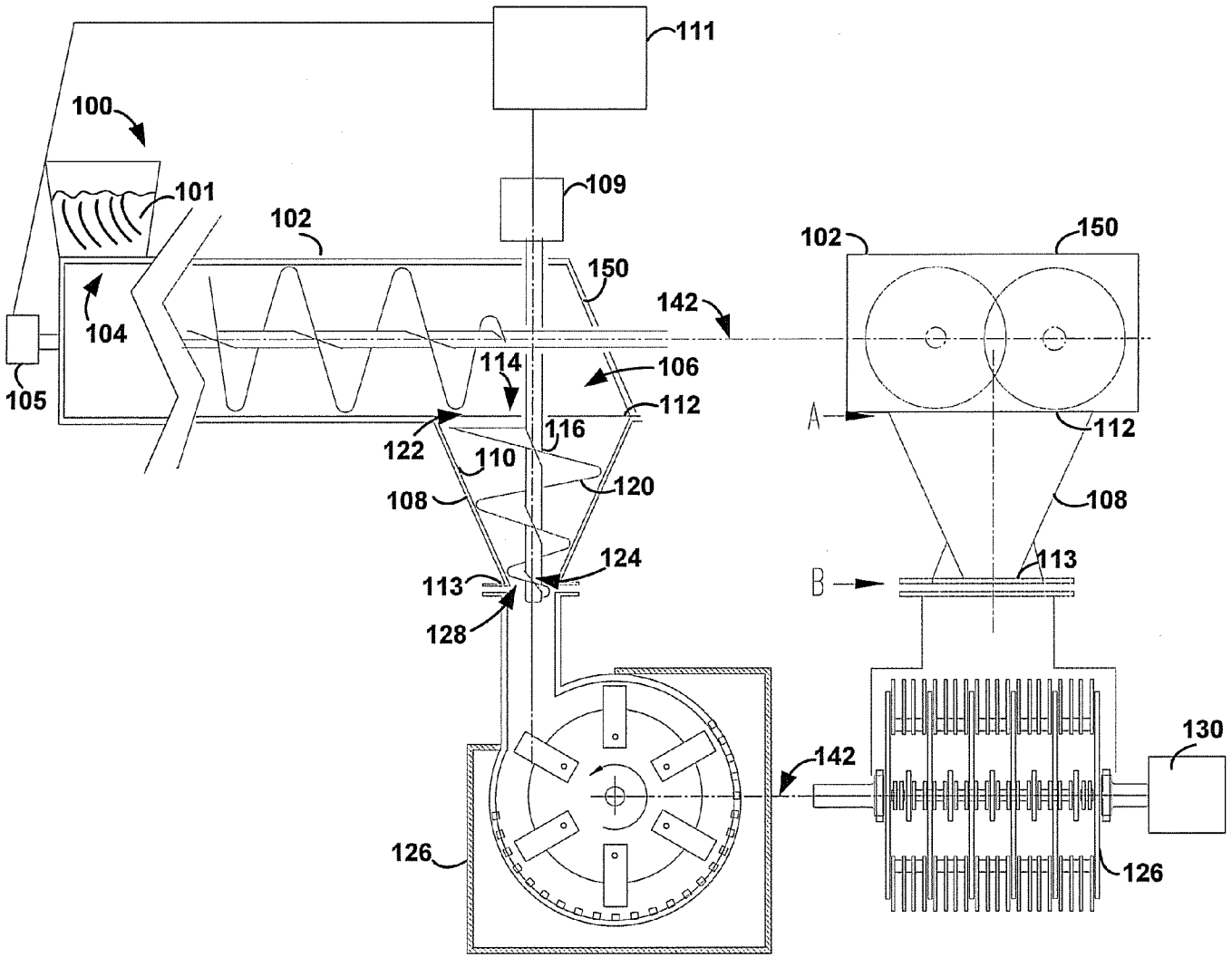
FIG. 1 is a somewhat schematic cross-sectional view of a compactor feeder in accordance with an exemplary embodiment of the invention.
FIG. 2 is a somewhat schematic end sectional view of the apparatus of FIG. 1.

The present invention relates to methods and apparatuses for converting biomass having a relatively low density to biomass having an increased density, for feeding into a grinding, comminuting, pulverizing or other such apparatus ("grinding device"). Generally, the invention would include a compaction feeder having a hopper, a feeder connected to the hopper, a compactor including a screw compactor member, and some kind of controller to regulate and coordinate the rates of operation, as between the feeder, compactor and perhaps also the grinder. The method generally comprises providing biomass feed to a compaction feeder such as described by the apparatus. The resulting biomass feed has an increased density, such that the biomass may be fed to the grinding device, such as a hammer mill, at a rate sufficient to meet the operating capacity of the grinding device. In the environment where this invention has evolved (but is not necessarily so limited), the biomass can then be used in the preparation of a carbonaceous feedstock for catalytic gasification processes that generate gaseous products including, for example, methane.

Recent developments to catalytic gasification technology are disclosed in commonly owned US2007/0000177A1, US2007/0083072A1 and US2007/0277437A1; and U.S. patent application Ser. Nos. 12/178,380 (filed 23 Jul. 2008), 12/234,012 (filed 19 Sep. 2008) and 12/234,018 (filed 19 Sep. 2008). Further, the present invention can be practiced in conjunction with the subject matter of U.S. patent application Ser. No. 12/343,149, filed Dec. 28, 2008, entitled "STEAM GENERATING SLURRY GASIFIER FOR THE CATALYTIC GASIFICATION OF A CARBONACEOUS FEEDSTOCK"; and the following US Patent Applications, all filed concurrently herewith: Ser. No. 12/395,309, entitled "STEAM GENERATION PROCESSES UTILIZING BIOMASS FEEDSTOCKS"; Ser. No. 12/395,320, entitled "REDUCED CARBON FOOTPRINT STEAM GENERATION PROCESSES"; Ser. No. 12/395,372, entitled "CO-FEED OF BIOMASS AS SOURCE OF MAKEUP CATALYSTS FOR CATALYTIC COAL GASIFICATION"; Ser. No. 12/395,385, entitled "CARBONACEOUS FINES RECYCLE"; Ser. No. 12/395,429, entitled "BIOMASS CHAR COMPOSITIONS FOR CATALYTIC GASIFICATION"); Ser. No. 12/395,433, entitled "CATALYTIC GASIFICATION PARTICULATE COMPOSITIONS"; and Ser. No. 12/395,447, entitled "BIOMASS COMPOSITIONS FOR CATALYTIC GASIFICATION". All of the above are incorporated herein by reference for all purposes as if fully set forth.

These publications, patent applications, patents and other references mentioned herein, may be referred to so those of skill in the art in their entirety for all purposes as if fully set forth in this application. Unless otherwise defined, all technical and scientific terms used herein have the same meaning as commonly understood by one of ordinary skill in the art to which this disclosure belongs. In case of conflict, the present specification, including definitions, will control.

Although methods and materials similar or equivalent to those described herein can be used in the practice or testing of the present disclosure, suitable methods and materials are described herein.

Unless stated otherwise, all percentages, parts, ratios, etc., are by weight. When an amount, concentration, or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the end-points thereof, and all integers and fractions within the range. It is not intended that the scope of the present disclosure be limited to the specific values recited when defining a range, unless so stated in the claims.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus. Further, unless expressly stated to the contrary, "or" refers to an inclusive or and not to an exclusive or.

The use of "a" or "an" to describe the various elements and components herein is merely for convenience and to give a general sense of the disclosure. This description should be read to include one or at least one and the singular also includes the plural unless it is obvious that it is meant otherwise.

The materials, methods, and examples herein are illustrative only and, except as specifically stated, are not intended to be limiting.

Compactor Feeder

In general, according to the present invention, a compactor feeder may include a hopper within which biomass feed is contained. Some other kind of container or conveyor may be used in place of a hopper. A feeder is connected to the hopper, and the feeder has an inlet and a charging end. Relatively low-density materials are conveyed from the hopper to the charging end of the feeder. The compactor feeder further includes a compactor, into which the charging end of the feeder communicates with, for receiving the charge of the feeder. The compactor, such as a screw compactor, has a screw member with a wide radial diameter at the top that decreases to a reduced diameter at the bottom. The bottom of the compactor discharges into a pulverizer, grinder or the like, such as a hammer mill.

Relatively low-density biomass feed is forced from the charging end of the feeder into the compactor at a rate so as to substantially fill the compactor at the top. The compactor member takes the biomass feed and compacts it to an increased density relative to the density of the material at the top before discharge to the pulverizer. Preferably, the compactor feeder compacts the relatively low-density biomass material to a sufficient density and feeds the compacted material to the pulverizer at a rate that matches the pulverizer's design capacity.

Turning now to FIG. 1, a compactor feeder for feeding relatively low-density biomass materials into a pulverizer or grinding device, such as a hammer mill, is described. In operation, the compactor feeder compacts relatively low-density biomass material to a sufficient density to take advantage of a grinding device's design capacity, which is defined in pounds per hour.

Compactor feeder includes a feeder (102) connected to a hopper (100) within which biomass feed (101) is contained. Feeder (102) has an inlet (104) and a charging end (106). The inlet of the feeder may be connected to the hopper (100) by a suitable connection means. For example, the inlet (104) of the feeder (102) may be connected to a feed chute that extends from the hopper. Alternatively, the inlet (104) of the feeder (102) may be directly connected to the outlet of the hopper.

Biomass feed is conveyed from the hopper through inlet (104), and the feeder (102) conveys the biomass feed to the charging end (106). The feeder (102) is a double-screw feeder, but could be single-screw or same equivalent conveyance. Other feeders known in the art or later developed are possible as well. Feeder (102) has a drive motor (105).

A compactor (108) has a top (112) and a bottom (113). The compactor (108) has a tapered conical-shaped interior sidewall (110). Top (112) has an opening (114) that is in communication with the charging end (106) of feeder (102). The feeder (102) and the compactor (108) are mechanically attached such that the charging end (106) of the feeder (102) overlaps with an opening (114) at the top (112) of the compactor. Compactor (108) has a drive motor (109) for a screw member (116).

Therefore, when biomass feed is conveyed through feeder (102) to the charging end (106), the feeder charges the biomass feed to the opening (114). The compactor (108) further includes a screw compactor member (or auger) (116). Screw compactor member (116) preferably has at least one flight (120) that generally conforms to the interior sidewall (110). Additional flights on the screw compactor member are possible as well. Screw compactor member (116) has a first wide radial diameter (122) at the top (112) and a reduced diameter (124) relative to the first wide radial diameter (122) at bottom (113). The bottom (113) has a discharge opening (128) that is in communication with a pulverizer or other grinding device, such as hammer mill (126).

A controller (111) controls the rate of the feeder at charging end (106) of feeder (102). Further, the controller controls the rate of compactor (108). Still further, the controller may control the operation of the hammer mill's motor (130). The motors and such a controller are well known in the art, and need not be described in detail herein.

The feeder (102) is preferably positioned generally or essentially horizontal with respect to a vertical axis of the compactor (108). Similarly, the compactor is preferably generally or essentially vertical, with respect to the horizontal axis (142) of the feeder and the hammer mill, as depicted in FIG. 1. The aspects of horizontal and/or vertical are just typical for these components, but the invention need not be limited just to those orientations.

In operation, the compactor feeder preferably operates to compact or densify biomass feed that is forced through it. Compactor (108) of the compactor feeder accomplishes this compaction, or densification, by forcing an amount of biomass feed into a smaller area of compactor (108) as the material moves from the top (112) to the bottom (113) of the conical-shaped compactor. The greater the difference between the first wide radial diameter (122) at the top (112) to the reduced diameter (124) at the bottom (113), the greater the compaction or densification of the biomass material will be. Modifications of the pitch of the flight can also yield alterations in the manner of compaction.

In a preferred embodiment, the ratio between first wide radial diameter (122) at the top (112) to the reduced diameter (124) of the bottom (113) is within a range from about 1.5:1 and 3:1. Therefore, at the lower end of the range the top diameter (122) is about 1.5 times the bottom diameter (124). As an example, the top diameter (122) may be 3 feet, and the bottom diameter (124) may be 2 feet. At the high end of the preferred range, the top diameter (122) is about 3 times the bottom diameter (124). For example, the top diameter (122) may be 3 feet, and the bottom diameter (124) may be 1 foot. It should be understood that this range is set for as an example, and the ratio between the two diameters may fall above or below this preferred range.

In this embodiment, the amount of compaction of the biomass material depends on this ratio between first wide radial diameter (122) at the top (112) to the reduced diameter (124) of the bottom (113). The area of a cross-section of the compactor at the top (112) is $\pi r^2$; similarly, the area of a cross section of the compactor at the bottom (113) is $\pi r^2$. Since the bottom radius is smaller, as the screw compactor member (116) pushes biomass from the top (112) towards the bottom (113), the biomass will be forced into a reduced area and, therefore, will compact to a greater density.

For example, when a top diameter is two times a bottom diameter, biomass forced through such a compactor may be compacted by up to a factor of 4. Since the radius at the top is two times the radius at the bottom, the area at the top of the compactor is then four times greater than the area at the bottom. Since the same amount of biomass feed at a cross section of the top is forced into a cross section at the bottom, the feed must fit into an area that is ¼ the size of its original area. Therefore, the density of the biomass feed may quadruple. As another example, if the top diameter is three times the size, the biomass feed may become nine times as dense.

The biomass feed used in the compactor feeder may be any biomass feed of relatively low-density. For example, any biomass feed of a density of less than 20 pounds per cubic foot may be used. Examples of different biomass feeds of densities less than 20 pounds per cubic foot include coarsely chopped bagasse, cornstover, switchgrass, other grasses, and other herbaceous biomass materials. Other biomass feeds and biomass like feeds are possible as well.

In addition to depending on the ratio between the top and bottom diameter of the conical-shaped compactor, the compacted density also depends on the original density of the biomass feed. When biomass feed is sent through compactor feeder, the biomass feed preferably increases in density. For example, bagasse typically has a density of approximately 7-10 pounds per cubic foot. If bagasse is fed into a compactor, where the ratio of the top diameter of the compactor 108 to the bottom diameter is 2:1, the density of the bagasse could reach 28-40 pounds per cubic foot.

A conventional compactor that could be adapted for use in accordance with exemplary embodiments may be obtained from Anderson-Crane Conveyors of Minneapolis, Minn. and Orthman Conveying Systems of Columbia, Mo., for instance.

Increasing the density of low-density biomass feed is extremely beneficial because feeding biomass of increased density to a grinding device such as a hammer mill allows one to take advantage of the operating design capacity of the grinding device. The design capacity of a hammer mill may be defined in terms of how many pounds the hammer mill can process per hour (or minute).

A typical hammer mill may have an operating capacity of 25,000 to 35,000 pounds per hour (or, 416 to 583 pounds per minute). Accordingly, taking full advantage of the operating capacity requires supplying feed to the hammer mill at a flow rate sufficient to meet 25,000 to 35,000 pounds per hour.

The compactor feeder preferably operates to densify a stream of coarsely chopped biomass feed to a specified bulk density (e.g., 30 to 40 pounds per cubic foot) and feed the densified material to a hammer mill at a fixed volumetric flow rate (cubic feet per minute) that will deliver a mass flow rate (pounds per minute) required by the hammer mill to achieve its full design capacity. By increasing the density of a material (e.g., from 10 pounds per cubic foot to 40 pounds per cubic foot) with the compactor feeder, it is possible to feed the material to a hammer mill at more pounds per hour. It is typically not possible to meet 25,000 to 35,000 pounds per hour by discharging low density materials into the hammer mill's feed chute. When discharging a material having a density of 10 to 20 pounds per cubic foot into a hammer mill's feed chute, it may only be possible to achieve a flow rate sufficient to supply 2,000 to 10,000 pounds per hour to the hammer mill. However, if the density of the material is increased, it is possible to achieve a mass flow rate sufficient to meet the operating capacity.

Beneficially, the power sources expended (e.g., horsepower) per pound are less when material is supplied at a rate sufficient to meet the operating capacity. In other words, supplying material at a mass flow rate that is below the hammer mill's operating capacity wastes valuable power resources; it is inefficient.

These values of typical operating capacities and flow rates referred to above are set forth as examples only. Hammer mills and other pulverizers and grinding devices may have differing operating capacities and, therefore, may require different mass flow rates. For instance, larger hammer mills and other pulverizers and grinding devices may have operating capacities over 130,000 pounds per hour. Larger operating capacities are possible as well. Further, the flow rates may be different for different densities of materials. It should be understood the compaction and flow rates of the compactor feeder can be adjusted by the controller to work on other grinding devices with operating capacities not mentioned.

The controller for the compactor feeder may include a processor, and data storage, and a plurality of motors (105, 109, 130). For instance, the controller may coordinate a first motor (105) for controlling the rate of the feeder (102) at charging end (106) into the compactor (108) and a second motor (109) for controlling the rate of compactor (108) at the discharge opening (124) into hammer mill (126), and further hammer mill motor (130).

The controller preferably drives the screw member (116) of compactor (108) at a rate such that the discharge of the compactor into the hammer mill substantially fills the hammer mill to the design capacity of the hammer mill. The controller operates to deliver biomass feed in pounds per minute at a rate substantially equal to the design capacity. Therefore, if the design capacity is 500 pounds per minute, the controller drives the screw member of the compactor to deliver biomass at a rate of 500 pounds per minute.

The rate at which biomass is forced out of the compactor to deliver 500 pounds per minute will depend on how dense the biomass material is. For example, the controller will have to drive the screw member more quickly to deliver 500 pounds per minute for a material with a density at discharge from the compactor of 30 pounds per cubic foot than for a material with a density of 40 pounds per cubic foot.

Additionally, the rate at which biomass is forced out of the compactor will depend on the rate feed need to be supplied to the hammer mill. For example, the controller will have to drive the screw member more quickly to deliver 500 pounds per minute than 400 pounds per minute.

In practice, the controller coordinates the respective rates of at least the feeder and the compactor. Since the compactor will continually be forcing material from the top to the bottom, the feeder operates to keep the compactor full at the top.

As described above, the feeder (102) and compactor (108) communicate with each other at the charge end of the feeder and opening at the top of the compactor. Preferably, the compactor is enclosed above the top (112), and the feeder is operated so as to maintain the compactor substantially full above a beginning of screw flight (120) at the top (112). The compactor enclosure may be a housing (150). In operation, the controller may control the rate of the feeder (102) so as to keep housing (150) substantially full at all times during operation. When the housing (150) is substantially full, the feeder (102) will be full above a beginning of screw flight (120). Since the housing is preferably always substantially full, the compactor (108) will have enough material available to maintain the desired flow rate necessary to meet the operating capacity of the hammer mill.

In addition, a method is described for feeding relatively low-density biomass materials into a pulverizer or grinding device. The method includes providing biomass feed to a compactor feeder, where the compactor feeder includes the features described above. The method further includes controlling the rate of the feeder (102) at charging end (106) into the compactor (108) at a rate so as to substantially fill compactor (108) at the top (112). The method further includes controlling the rate of compactor (108) at the discharge opening (124) into hammer mill (126) such that the rate of compactor (108) substantially equals a design capacity of hammer mill (126).

Biomass

The term "biomass" as used herein refers to carbonaceous materials derived from recently (for example, within the past 100 years) living organisms, including plant-based biomass, animal-based biomass, and catalytic biomass. For clarification, biomass does not include fossil-based carbonaceous materials, such as coal.

The term "plant-based biomass" as used herein means materials derived from green plants, crops, algae, and trees, such as, but not limited to, sweet sorghum, bagasse, sugarcane, bamboo, hybrid poplar, hybrid willow, albizia trees, eucalyptus, alfalfa, clover, oil palm, switchgrass, sudangrass, millet, jatropha, and *miscanthus* (e.g., *Miscanthus×giganteus*). Biomass further include wastes from agricultural cultivation, processing, and/or degradation such as corn cobs and husks, corn stover, straw, nut shells, vegetable oils, canola oil, rapeseed oil, biodiesels, tree bark, wood chips, sawdust, and yard wastes.

The term "animal-based biomass" as used herein means wastes generated from animal cultivation and/or utilization. For example, biomass includes, but is not limited to, wastes from livestock cultivation and processing such as animal manure, guano, poultry litter, animal fats, and municipal solid wastes (e.g., sewage).

The term "catalytic biomass" as used herein refers to biomass, as defined herein, whose combustion produces an ash comprising a combination of alkali metal compounds (e.g., $K_2O$ and/or $Na_2O$) that can function as a gasification catalyst in the context of the present invention. For example, catalytic biomass includes, but is not limited to, switchgrass, hybrid poplar, hybrid willow, sugarcane, bamboo, *miscanthus*, cotton stalks, flax, verge grass, alfalfa, sunflower, poultry litter, kenaf (*hibiscus cannabinus*), thistle, and almond shells and husks.

Biomass can have a density that varies depending on its source. As used herein, the term "low-density biomass" or "low-density biomass materials" means biomass, such as described above, having a density up to about 20 pounds per cubic foot. Accordingly, the method or apparatus of the invention provides a biomass comprising an increased density. As used herein, the term "biomass having an increased density," "high-density biomass," "increased density biomass," or "higher density biomass" means biomass having a density of about 30 to about 50 pounds per cubic foot.

An exemplary embodiment has been described above. Those skilled in the art will understand, however, that changes and modifications may be made to those examples without departing from the scope of the claims.

I claim:

1. A compactor feeder for feeding relatively low-density biomass materials into a grinding device, comprising:

a hopper within which a biomass feed is contained;

a feeder connected to said hopper having a first inlet and a charging end, wherein said biomass feed is conveyed from said hopper to said charging end;

a compactor having a tapered conical-shaped interior sidewall with an interior top and bottom, said top having an opening into which said feeder charging end communicates for receiving the charge of said feeder, said compactor further including a screw compactor member that has at least one flight that generally conforms to said interior sidewall, such that said screw compactor member has a first wide radial diameter at said top decreasing to a reduced diameter relative to said first diameter at said bottom, said bottom further having a discharge opening in communication with a grinding device;

a controller for controlling the rate of said feeder at said charging end into said compactor; and a grinding device in communication with said discharge opening;

whereby, in the operation of said apparatus, said biomass feed is forced from said charging end of said feeder into said compactor at a rate so as to substantially fill said compactor at said top and said compactor member takes said biomass feed and compacts it to an increased density relative to a density at said top before discharge to said grinding device; and the controller further controls drives for said feeder, compactor and grinding device, and coordinates said drives so as to yield said increased density so that said compactor is driven at a rate such that said discharge into said grinding device substantially fills said grinding device to a design capacity of said grinding device.

2. The compactor feeder of claim 1, wherein said grinding device is a hammer mill.

3. The compactor feeder of claim 2, comprising:

an essentially horizontal double-screw feeder having an first inlet and a charge end;

an essentially vertical tapered screw conical compactor section having a compactor inlet and a discharge end, said first discharge end is coupled to said compactor inlet, a ratio of the diameter of said compactor at a top of said tapered screw to a diameter of said compactor discharge end is within a range of about 1.5:1 to about 3:1;

a hammer mill having a feed chute, wherein said compactor discharge end is coupled to said feed chute, and wherein said hammer mill has an operating design capacity capable of processing material fed into said hammer mill that has a density within a range of about 30 pounds per cubic foot to about 50 pounds per cubic foot; and a first motor driving said horizontal double-screw feeder and a second motor driving said vertical tapered screw conical section, wherein said first and second motors are operated to keep said conical compactor section substantially completely filled with the biomass materials, and biomass compacted within said compactor is discharged at a rate that is substantially equal to the operating design capacity of said hammer mill.

4. The compactor feeder of claim 1, wherein said feeder is a double-screw feeder.

5. The compactor feeder of claim 4, wherein said double-screw feeder is positioned generally horizontally with respect to a vertical axis of said compactor.

6. The compactor feeder of claim 1, wherein said compactor is enclosed at said top, and said feeder is operated so as to maintain said compactor full above a beginning of said screw flight at said top.

7. The compactor feeder of claim 6, wherein said compactor enclosure is a housing and said housing is maintained substantially full during operation.

8. The compactor feeder of claim 1, wherein the ratio of said first wide radial diameter at said top and said reduced diameter relative to said first diameter at said bottom is within a range from about 1.5:1 to about 3:1.

9. A method for feeding relatively low-density biomass materials into a grinding device, the method comprising the steps of:

providing a compactor feeder for feeding relatively low-density biomass materials into a grinding device;

controlling the rate of said feeder at the charging end into said compactor at a rate so as to substantially fill said compactor at said top; and controlling the rate of said compactor at said discharge opening into said grinding device so as to substantially fill said grinding device such that the rate of said compactor substantially equals a design capacity of said grinding device, wherein the compactor feeder comprises:

a hopper within which a biomass feed is contained;

a feeder connected to said hopper having a first inlet and a charging end, wherein said biomass feed is conveyed from said hopper to said charging end;

a compactor having a tapered conical-shaped interior sidewall with an interior top and bottom, said top having an opening into which said feeder charging end communicates for receiving the charge of said feeder, said compactor further including a screw compactor member that has at least one flight that generally conforms to said interior sidewall, such that said screw compactor member has a first wide radial diameter at said top decreasing to a reduced diameter relative to said first diameter at said bottom, said bottom further having a discharge opening in communication with a grinding device;

a controller for controlling the rate of said feeder at said charging end into said compactor; and a grinding device in communication with said discharge opening;

whereby, in the operation of said compactor feeder, said biomass feed is forced from said charging end of said feeder into said compactor at a rate so as to substantially fill said compactor at said top and said compactor member takes said biomass feed and compacts it to an increased density relative to a density at said top before discharge to said grinding device; and the controller further controls drives for said feeder, compactor and grinding device, and coordinates said drives so as to yield said increased density so that said compactor is driven at a rate such that said discharge into said grinding device substantially fills said grinding device to a design capacity of said grinding device.

10. The method of claim 9, wherein said grinding device is a hammer mill.

11. The method of claim 9, wherein the compactor feeder comprises:

an essentially horizontal double-screw feeder having an first inlet and a charge end;

an essentially vertical tapered screw conical compactor section having a compactor inlet and a discharge end, said first discharge end is coupled to said compactor inlet, a ratio of the diameter of said compactor at a top of said tapered screw to a diameter of said compactor discharge end is within a range of about 1.5:1 to about 3:1;

a hammer mill having a feed chute, wherein said compactor discharge end is coupled to said feed chute, and wherein said hammer mill has an operating design capacity capable of processing material fed into said hammer mill that has a density within a range of about 30 pounds per cubic foot to about 50 pounds per cubic foot; and a first motor driving said horizontal double-screw feeder and a second motor driving said vertical tapered screw conical section, wherein said first and second motors are operated to keep said conical compactor section substantially completely filled with the biomass materials, and biomass compacted within said compactor is discharged at a rate that is substantially equal to the operating design capacity of said hammer mill.

12. The method of claim 9, wherein providing biomass feed to a compactor feeder comprises providing at least one type of biomass feed selected from the group of chopped bagasse, cornstover, switchgrass, grasses and straw.

13. The method of claim 9, wherein said increased density is about 40 pounds per cubic foot or greater.

14. The method of claim 9, wherein said feeder is a double-screw feeder.

15. The method of claim 9, wherein said compactor is enclosed at said top, and said feeder is operated so as to maintain said compactor full above a beginning of said screw flight at said top.

16. The method of claim 15, wherein said compactor enclosure is a housing and said housing is maintained substantially full during operation.

* * * * *